US006786786B1

(12) United States Patent
Davis

(10) Patent No.: US 6,786,786 B1
(45) Date of Patent: Sep. 7, 2004

(54) URETHANE FLOTATION DEVICE

(76) Inventor: Dale J. Davis, 77 Alexander Way, Suisun, CA (US) 94585

( * ) Notice: Subject to any disclaimer, the term of this patent is extended or adjusted under 35 U.S.C. 154(b) by 80 days.

(21) Appl. No.: 10/602,763

(22) Filed: Jun. 25, 2003

(51) Int. Cl.[7] ..... B63C 9/08
(52) U.S. Cl. ..... 441/120; 441/129
(58) Field of Search ..... 441/120, 129, 441/115

(56) References Cited

U.S. PATENT DOCUMENTS 4,580,988 A * 4/1986 Correll ..... 441/130
4,986,786 A * 1/1991 Helt et al. ..... 441/120
5,356,325 A 10/1994 Awbrey et al.
5,382,184 A 1/1995 DiForte, Jr.
5,465,472 A 11/1995 Matoba
5,562,514 A * 10/1996 Rowe ..... 441/130
5,791,958 A 8/1998 Yeung
6,374,467 B1 4/2002 Chen

* cited by examiner

*Primary Examiner*—Ed Swinehart
(74) *Attorney, Agent, or Firm*—Richard C. Litman

(57) ABSTRACT

A flotation device adapted for use by a person in a body of water and float with minimal effort therein. The flotation device comprises a central section adapted to fit between a person's legs, a front and rear flotation packs, and an adjustable connection means. The flotation packs each have opposite ends, and a lower and upper side. The central section has opposite ends connected to the lower sides of the flotation packs. The adjustable connection means reversibly connects the respective opposite ends of the flotation packs. The flotation packs are made of any suitable floating material such as urethane closed cell foam that meets U.S. Coast Guard requirements (UL 1191). A pocket is optionally attached to one or both of the flotation packs.

18 Claims, 6 Drawing Sheets

URETHANE FLOTATION DEVICE

BACKGROUND OF THE INVENTION

1. Field of the Invention

The present invention relates to flotation devices and more specifically to a urethane flotation device adapted to allow a person to float in a body of water with minimum effort.

2. Description of the Related Art

Many people like relaxing and having fun in water. For example, small boat users often like to be in the water adjacent to their boats. Sometimes the small boat users like to float in the water with minimum effort next to their boats. To stay afloat with minimum effort some small boat users sit on one or more life jackets as an aid to stay afloat. Sitting on life jackets is problematic and in some circumstances possibly dangerous.

Water lovers often like to float and laze under a hot sun for varying periods of time with minimum effort. Thus, there is a need for a flotation device that enables a user to relax in water with minimum swimming effort.

Several efforts have been made to address these problems. U.S. Pat. No. 5,791,958, issued Aug. 11, 1998 to M. F. E. Yeung, describes an inflatable float for use in water. The '958 inflatable float comprises two air chambers. The two air chambers of the '958 device are vulnerable to tearing and cuts that might cause the air chambers to deflate and thereby reduce the flotation properties of the '958 device. Thus, there is a need for a flotation device that does not loose its flotation properties as a result of a tear or cut.

U.S. Pat. No. 5,382,184, issued Jan. 17, 1995 to M. P. DiForte Jr., describes a personal flotation device comprising an elongated member for encircling a wearer's waist. The, '184 device comprises air chambers that are filled using compressed air from a compressed gas bottle. The '184 device is complicated to use and is susceptible to punctures that can cause the '184 device to loose some of its flotation properties. Thus, there is a need for a simple flotation device that does not rely on compressed air.

U.S. Pat. No. 5,356,325, issued Oct. 18, 1994 to Awbrey et al., describes a life preserver based on a short pants design for use in sporting activities. The '325 apparatus is used in combination with a specific pair of short pants specially adapted to function as a buoyancy device. A person desiring buoyancy support must wear the special short pants. The requirement to wear a special pair of short pants limits the use of the '325 apparatus. Thus, there is a need for a flotation device that can be worn absent a specifically designed pair of short pants.

None of the above inventions and patents, taken either singly or in combination, is seen to describe the instant invention as claimed. Thus a urethane flotation device solving the aforementioned problems is desired.

SUMMARY OF THE INVENTION

A flotation device adapted for use by a person in a body of water and float with minimal effort therein. The flotation device comprises, a central section adapted to fit between a person's legs, a front and rear flotation packs, and an adjustable connection means. The flotation packs each have opposite ends, and a lower and upper side. The central section has opposite ends connected to the lower sides of the flotation packs. The adjustable connection means reversibly connects the respective opposite ends of the flotation packs.

The flotation packs are made of any suitable floating material such as urethane closed cell foam that meets U.S. Coast Guard requirements (UL 1191). A pocket is optionally attached to one or both of the flotation packs.

Accordingly, it is a principal object of the invention to provide a flotation device comprising urethane.

It is another object of the invention to provide a flotation device that does not lose its floating properties as a result of an inadvertent tear or cut.

It is a further object of the invention to provide a flotation device that does not require a compressed air source.

Still another object of the invention is to provide a urethane flotation device that can be worn by a user wearing general swimming attire.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to flotation devices and more specifically to a urethane flotation device adapted to allow a person to float in a body of water with minimum effort.

Figure 1:
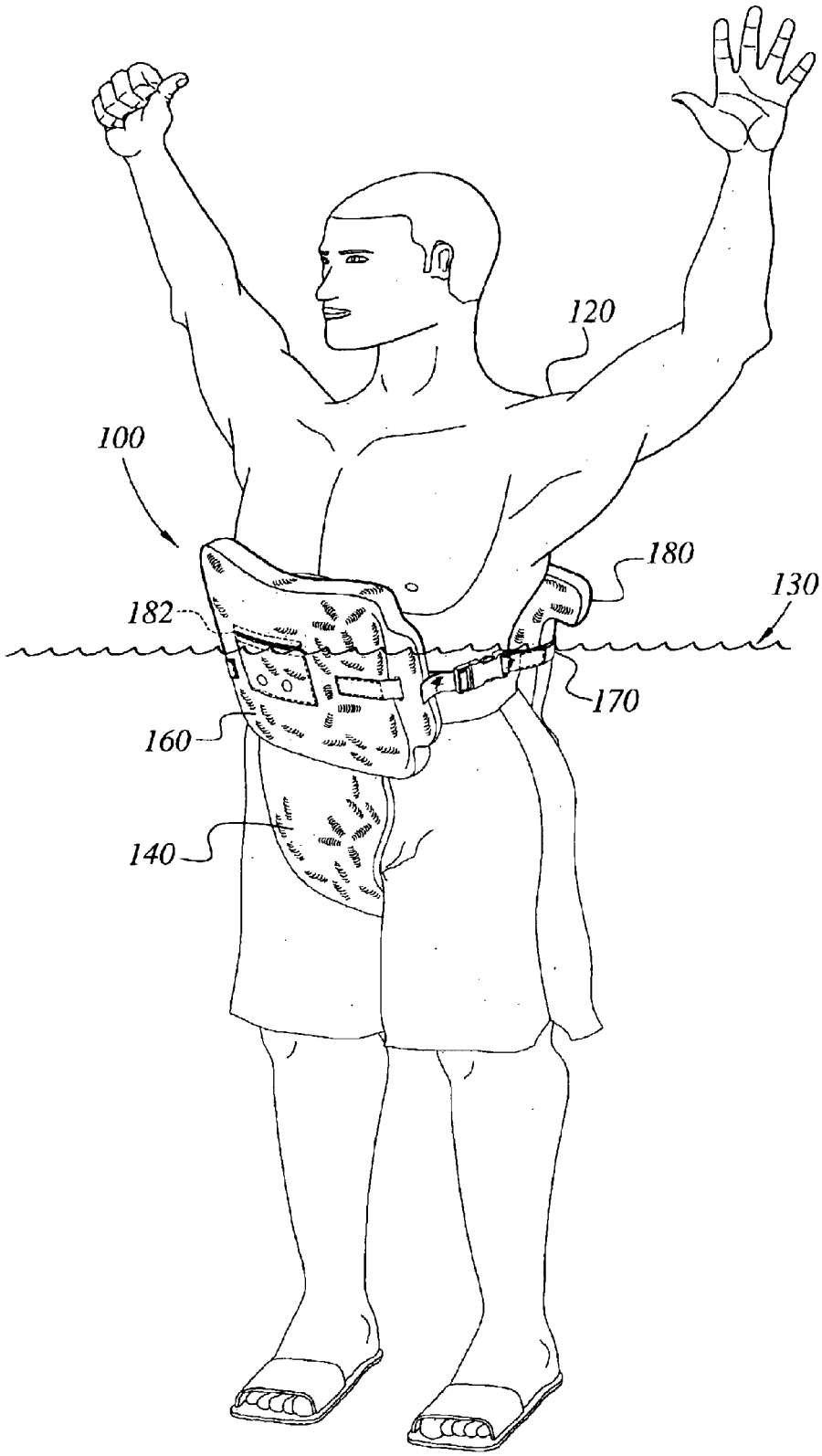
FIG. 1 is an environmental, perspective view of a urethane flotation device according to the present invention.

Fig. 1 shows an environmental, perspective view of a flotation device 100 according to the invention, which is shown being worn by a wearer 120. The flotation device 100 is adapted to enable a wearer 120 to float in a body of water 130 with minimum effort. Broadly, the flotation device 100 comprises a central section 140, a front flotation pack 160, a rear flotation pack 180, and an adjustable connection means 170.

The central section 140 has a narrow section 165 defining a first 200 and second 220 opposite ends. The front flotation pack 160 has a first 240 and second 260 opposite ends and a lower 280 and an upper 300 side. The rear flotation pack 180 has a third 320 and fourth 340 opposite sides and a lower 360 and an upper 380 sides. The lower side 280 of the front pack 160 is attached to the first opposite end 200 of the central section 140, and the lower side 360 of the rear pack 180 is attached to the second opposite end 220 of the central section 140.

The flotation packs 160 and 180 are made of any suitable floating material such as urethane closed cell foam that meets U.S. Coast Guard requirements (UL 1191). A suitable source of urethane closed cell foam is AIREX™ that is available from Bob's Foam Factory, Inc. and meets UL 1191 (see URL, e.g., http://www.bobsfoam.com/airex.html). A thin layer of protective material, such as two millimeters of "nylon-2 neoprene fabric" (i.e., 2 mm thick neoprene with two sides of nylon covering) preferably covers the constituent parts of the flotation device 100, i.e. the flotation packs 160 and/or 180, and/or the central section 140. The terms "nylon-2 neoprene fabric" and "nylon #2 neoprene" are herein regarded as equivalent terms.

Figure 2A:
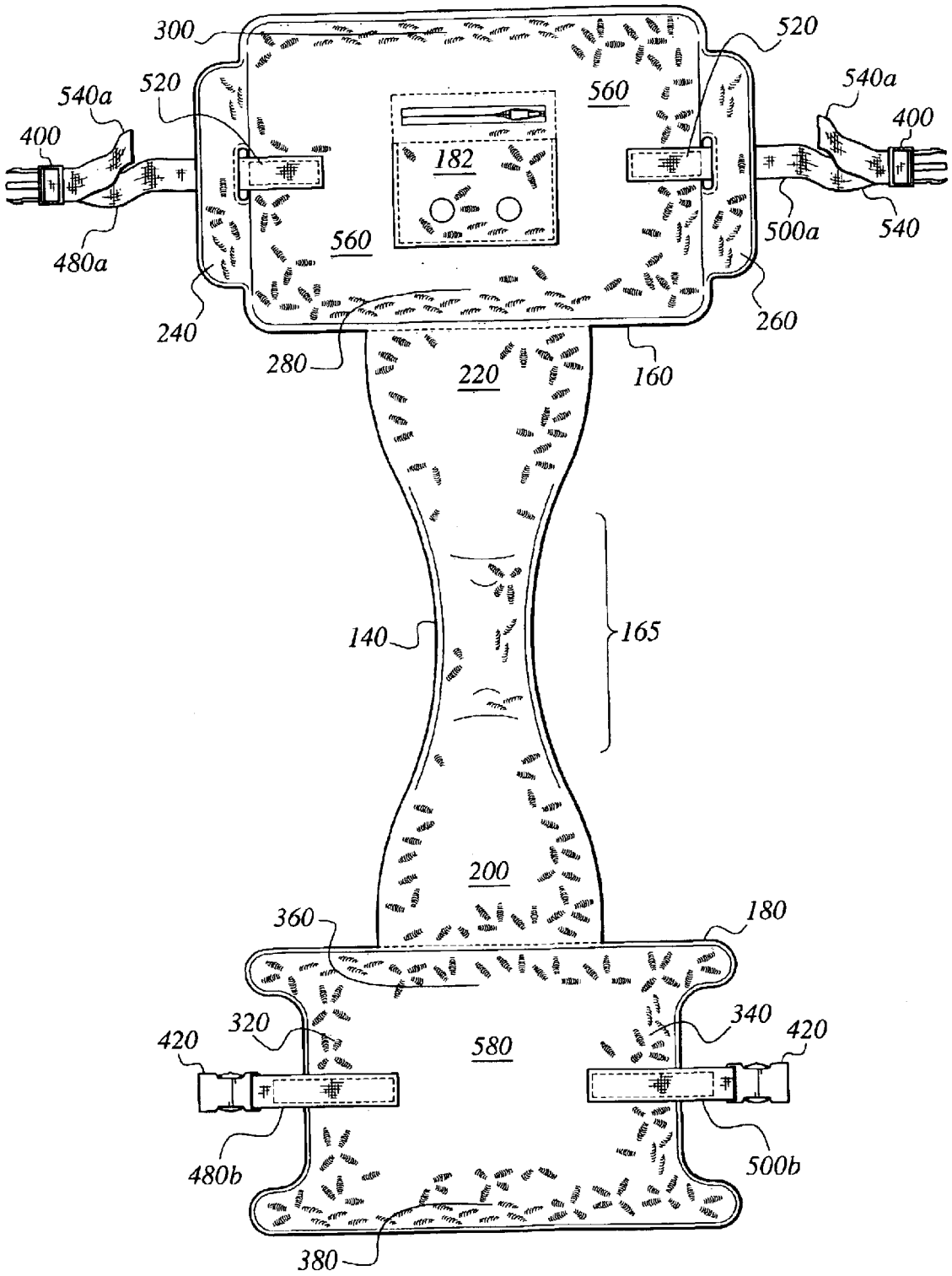
FIG. 2A shows the urethane flotation device, according to a first embodiment of the invention.
Figure 2B:
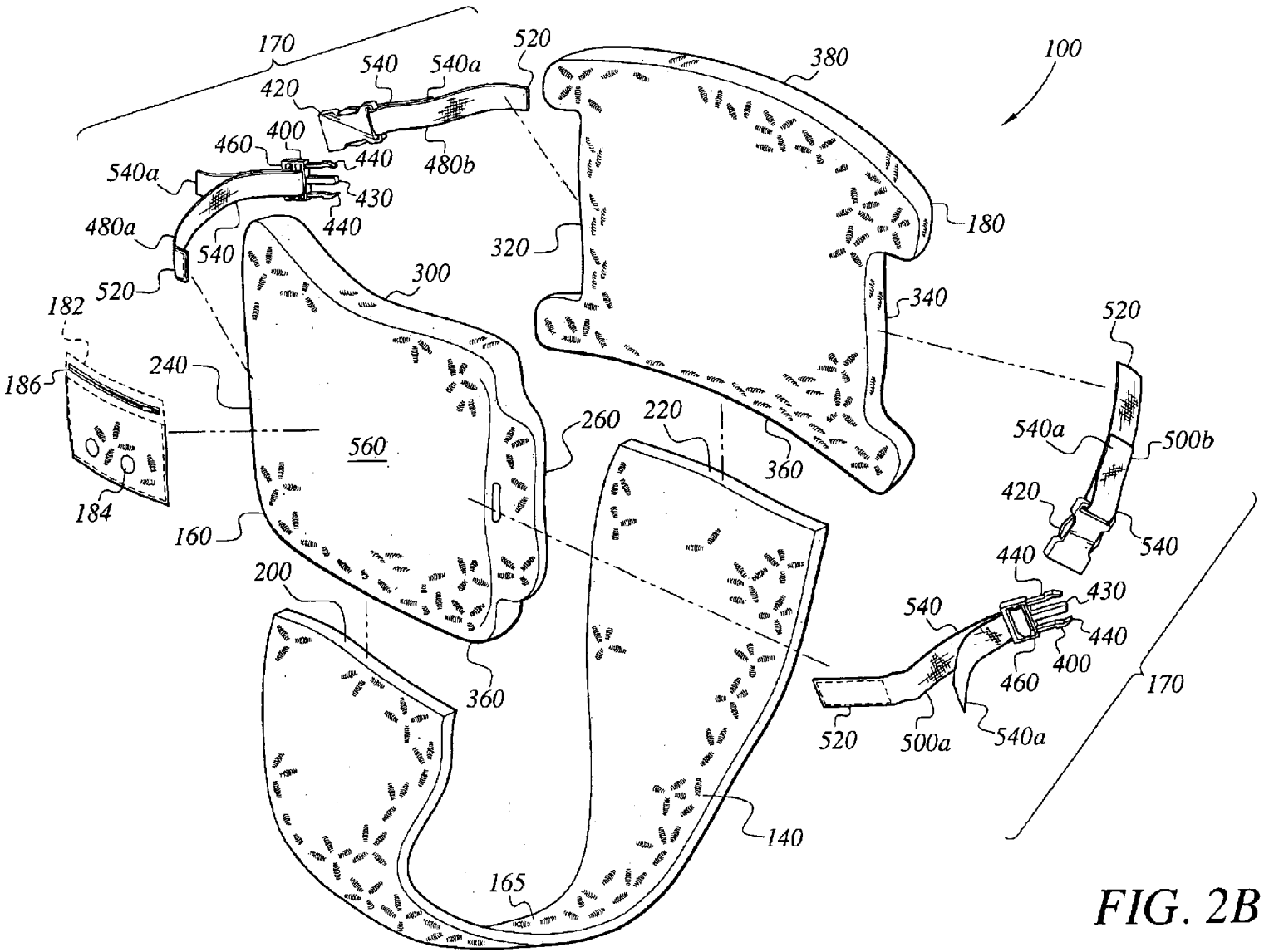
FIG. 2B is an exploded view of the flotation device shown in FIG. 2A.

Referring to FIGS. 2A and 2B which show the flotation device 100 according to the first embodiment of the invention. In this embodiment the adjustable connection means 170 comprises an adjustable strap buckle system employing at least one plug member 400 and at least one socket member 420. Each plug member 400 comprises at least one tongue 430, resiliently deflectable engaging legs, 440, and a strap attachment portion 460. Alternatively, the strap attachment portion 460 can form part of the socket member 420.

The plug member 400 and socket 420 member are well known and described, for example, in U.S. Pat. No. 5,465,472 (issued Nov. 14, 1995 to M. Hiroshi), and U.S. Pat. No. 6,374,467 (issued Apr. 23, 2002 to W. C. Chen); the '472 and '467 patents are incorporated herein by reference in their entirety.

Still referring to FIGS. 2A and 2B, the adjustable connection means 170 comprises a first pair of mating straps 480*a* and 480*b*, and a second pair of mating straps 500*a* and 500*b*; each strap defines a proximal 520 and distal 540 opposite ends in which the distal end 540 terminates in either a plug member 400 or a socket member 420, and the proximal ends 520 are attached separately to the opposite ends of the flotation packs 160 and 180 as shown in FIG. 2. The distal ends 540 have distal loose ends 540*a* threaded through either the strap attachment portion 460 of the plug member 400.

Referring to the figures in general, the flotation packs 160 and 180 respectively comprise an outer face 560 and 580. A pocket 182 is optionally attached to one or both of the outer faces 560 and 580. The optional pocket 182 can be used to securely store items such as coins. The optional pocket 182 can comprises at least one ventilation hole 184. The optional at least one ventilation hole 184 enables water to drain from the pocket 182 when the wearer 120 emerges from the water 130. The optional pocket 182, may also comprise a pocket zip 186; the zip 186 is preferably a plastic zipper that is resistant to water including salt water (i.e., seawater), and more preferably a plastic zipper available from Vislon™ such as the non-corroding YKK™ Vislon™ #10 zipper.

Figure 3:
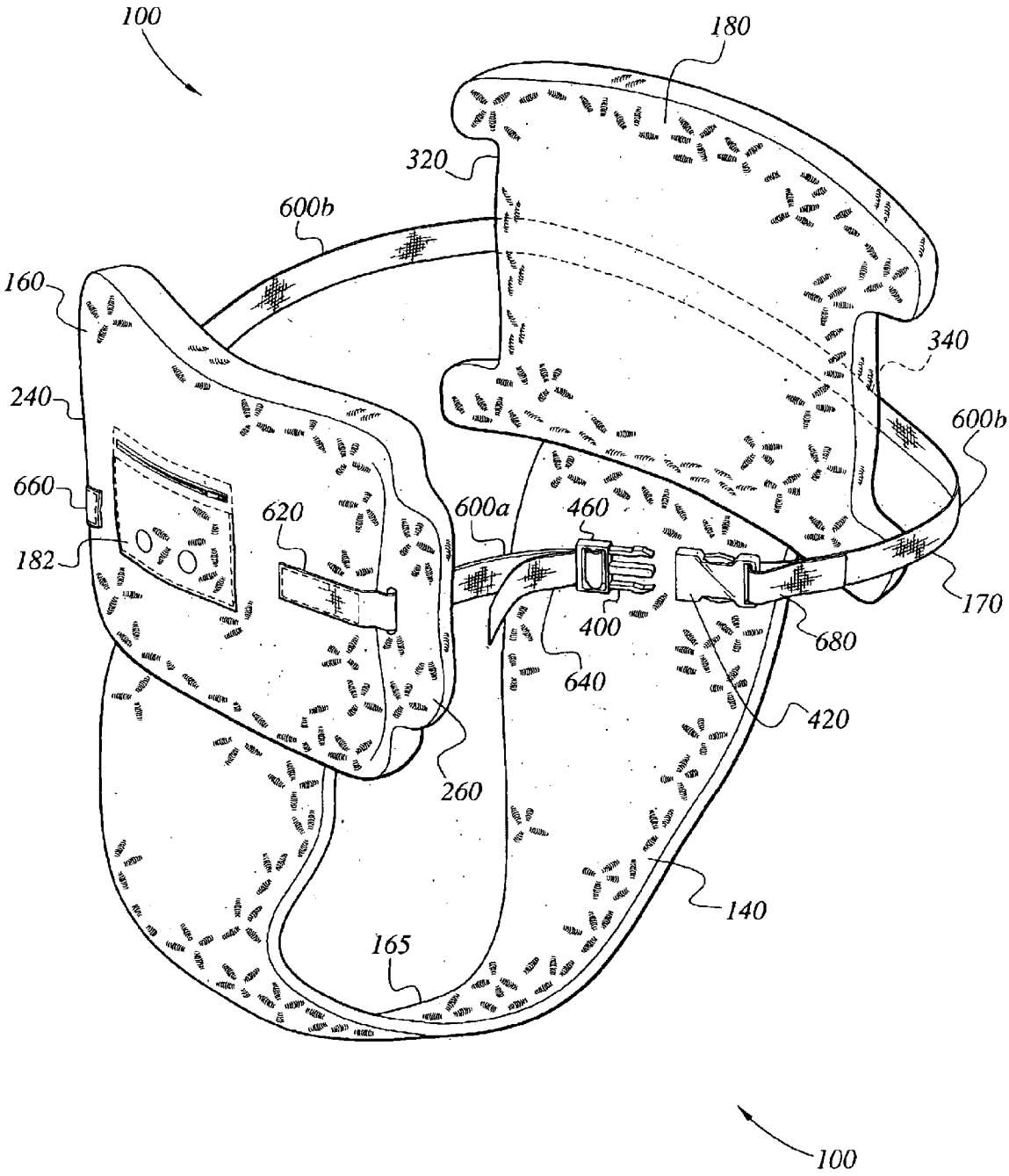
FIG. 3 shows the urethane flotation device, according to a second embodiment of the invention.

FIG. 3 shows a second embodiment of the invention in which the adjustable connection means 170 comprises a first 600*a* and second 600*b* mating straps to reversibly connect the flotation packs 160 and 180 around the trunk of the wearer 120. The strap 600*a* has a proximal end 620 attached to the flotation pack end 260 and a distal end 640 terminating in a plug member 400. The overall arrangement of strap 600*a* is very similar to the strap 500*a* in FIG. 2B. The strap 600*b* has a proximal end 660 attached to the opposite end 240 of the flotation pack 160 and a distal end 680 terminating in a socket member 420. The single strap 600*b* is sufficiently long to extend from the end 240 and wrap around the flotation pack 180 and mate with the strap 600*a* as shown in FIG. 3. It will be understood that the straps 600*a* and 600*b* may be arranged differently without detracting from the spirit of the invention, e.g. the straps 600*a* and 600*b* may alternatively terminate respectively in a plug member 400 and a socket member 420.

Figure 4:
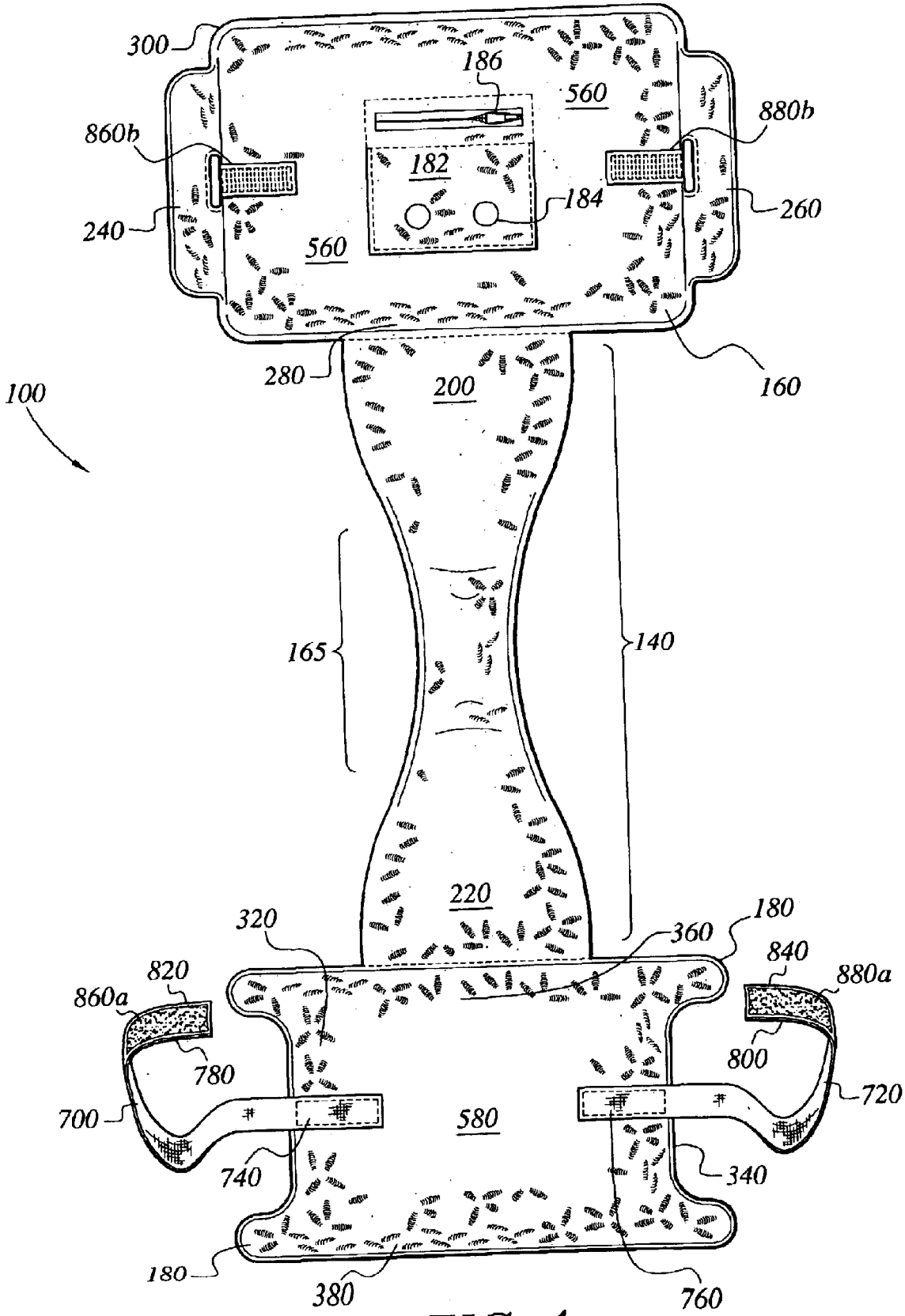
FIG. 4 shows the urethane flotation device, according to a third embodiment of the invention.

FIG. 4 shows a third embodiment of the invention in which the adjustable connection means 170 comprises a set of straps 700 and 720 with proximal ends 740 and 760, respectively, attached to the outer face 580 of the flotation pack 180. The straps 700 and 720 respectively comprise distal ends 780 and 800 and further comprise inner surfaces 820 and 840 that are at least partly covered in VELCRO™ strips 860*a* and 880*a* comprising minute hooks or loops. (VELCRO is a trademark of Velcro Industries B.V. of the Netherlands.) Complementary VELCRO™ attachment strips 860*b* and 880*b* are attached to the outer face 560 of the flotation pack 160; the complementary strips 860*b* and 880*b* comprise complementary loops or hooks, e.g., complementary strips 860*b* and 880*b* should comprise of loops if the strips 860*a* and 880*a* comprise minute hooks and visa versa. It should be understood that any suitable fastening means might be used, such as snap fasteners, to secure the distal ends 780 and 800 to the flotation pack 160. In addition, the arrangement of the straps 700 and 720, and complementary strips 860*b* and 880*b* may be arranged differently without detracting from the spirit or intent of the invention.

Figure 5:
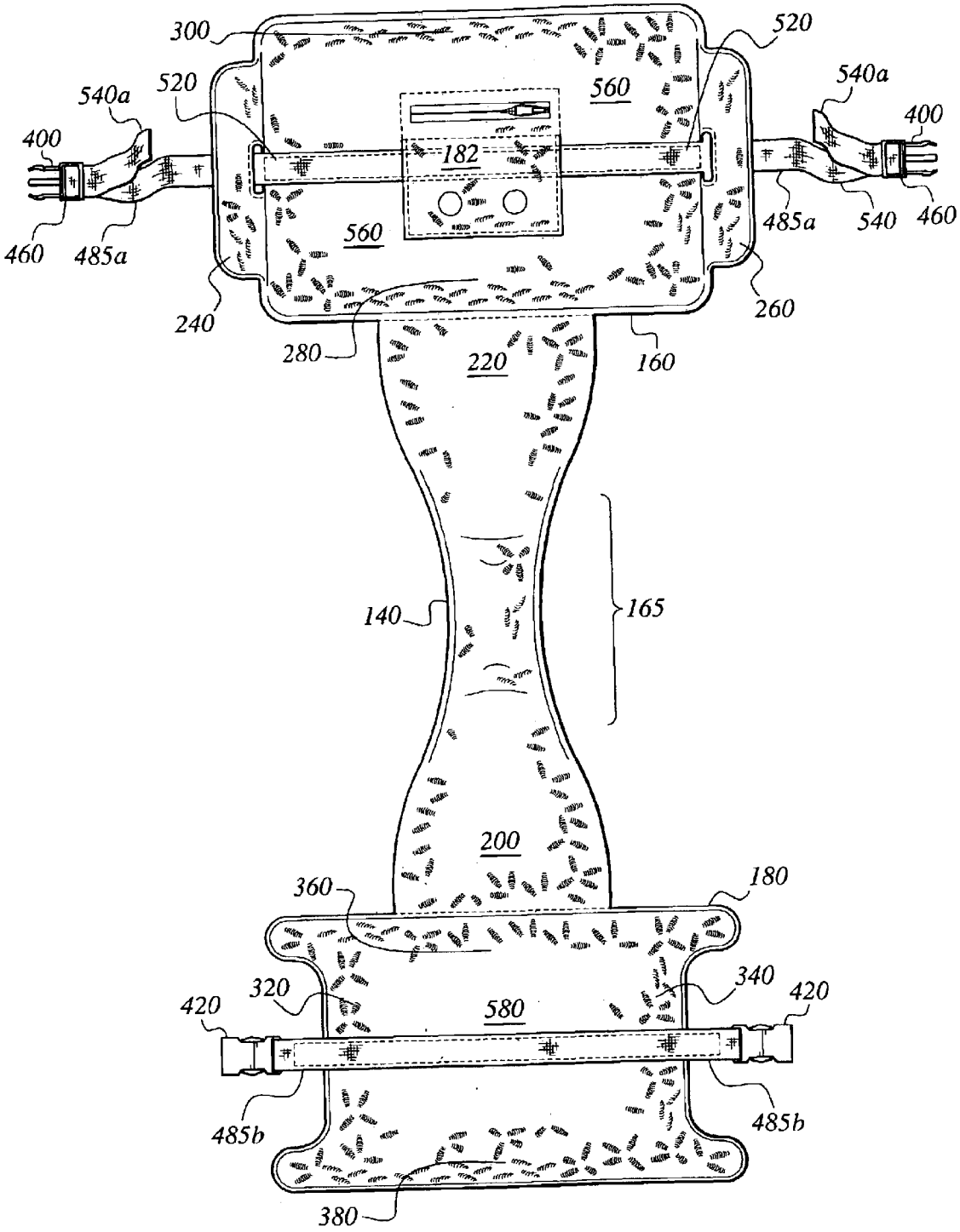
FIG. 5 shows the urethane flotation device, according to a fourth embodiment of the invention.

FIG. 5 shows the flotation device 100 according to the fourth embodiment of the invention. In this embodiment the adjustable connection means 170 comprises two mating straps 485*a* and 485*b*. The straps 485a and 485*b* each have a middle section stitched respectively to the outer faces 560 and 580. The strap 485*a* has opposite ends terminating in a plug member 400, and the strap 485*b* has opposite ends terminating in socket members 420. It should be understood that the ends of the straps 485*a* and 485*b* can differ terminate in either plug 400 or socket 420 members without detracting from the spirit of the claimed invention. The length of the strap 485*a* can be adjusted by threading the distal ends of the strap 485*a* through the strap attachment portion 460 and upon achieving a desired length the plugs 400 can be attached to the corresponding sockets 420.

It is to be understood that the present invention is not limited to the embodiments described above, but encompasses any and all embodiments within the scope of the following claims.

I claim:

1. A flotation device to enable a person to float with minimal effort in a body of water, comprising:

a central section having a first and second opposite ends, wherein the central section is adapted to fit between a person's legs;

a front and a rear flotation pack, wherein the front pack has a first and second opposite sides and a lower and upper end, wherein the rear pack has a third and fourth opposite sides and a lower and upper end, wherein the lower end of the front pack is attached to the first opposite end of the central section, and the lower end of the rear pack is attached to the second opposite end of the central section; and an adjustable connection means, wherein the adjustable connection means reversibly connects the front and rear flotation packs, whereby the flotation device can be fitted to a person by placing the central section between a person's legs and the front and rear flotation packs respectively to the front and rear of the person's trunk using the first and second reversible connection means thereby allowing the person to float with minimum effort in a body of water.

2. The flotation device of claim 1, wherein the first flotation pack has an outer face comprising a pocket, whereby the pocket enables a person floating in water to keep items secure.

3. The flotation device of claim 1, wherein the first flotation pack has an outer face comprising a pocket defining at least one ventilation hole therein, whereby the pocket enables a person floating in water to keep items secure therein and upon emerging from the water the pocket is able to drain of water via the at least one ventilation hole and thereby permit faster drying of the items.

4. The flotation device of claim 1, wherein the central section, front and rear flotation packs are covered with nylon #2 neoprene thereby providing a soft and comfortable feel when the flotation device is worn by a person.

5. The flotation device of claim 1, wherein the central section, front and rear flotation packs are covered with two-millimeters of nylon #2 neoprene thereby providing a soft and comfortable feel when the flotation device is worn by a person.

6. The flotation device of claim 1, wherein the central section comprises a flotation material.

7. The flotation device of claim 1, wherein the central section comprises a flotation material made of urethane closed cell foam.

8. The flotation device of claim 1, wherein the central section comprises a flotation material made of urethane closed cell foam that complies with U.S. Coast Guard requirements under UL 1191.

9. The flotation device of claim 1, wherein the front and rear flotation packs each comprise of urethane closed cell foam.

10. The flotation device of claim 1, wherein the front and rear flotation packs each comprising urethane closed cell foam that complies with U.S. Coast Guard requirements under UL 1191.

11. The flotation device of claim 1, wherein the adjustable connection means comprises at least one strap defining a distal end attached to a plug member, and at least one strap with a distal end terminating in a socket member.

12. The flotation device of claim 1, wherein the adjustable connection means comprises at least one VELCRO™ attachment and release system.

13. A flotation device to enable a person to float with minimal effort in a body of water, comprising:

a central section having a first and second opposite ends, wherein the central section is adapted to fit between a person's legs;

a front and a rear flotation pack each comprising urethane closed cell foam, wherein the front pack has a first and second opposite sides and a lower and upper end, wherein the rear pack has a third and fourth opposite sides and a lower and upper end, wherein the lower end of the front pack is attached to the first opposite end of the central section, and the lower end of the rear pack is attached to the second opposite end of the central section; and an adjustable connection means having a first and second mating straps with proximal and distal ends, wherein the proximal ends of the first and second mating straps are respectively attached to the first and second opposite sides of the front flotation pack, wherein the second mating strap is sufficiently long to wrap around the rear flotation pack and its distal end mate with the distal end of the first mating strap and thereby reversibly connect the front and rear flotation packs, whereby the flotation device can be fitted to a person by placing the central section between a person's legs and the front and rear flotation packs respectively to the front and rear of the person's trunk using the first and second reversible connection means thereby allowing the person to float with minimum effort in a body of water.

14. The flotation device of claim 13, wherein the central section, front and rear flotation packs are covered with nylon #2 neoprene thereby providing a soft and comfortable feel when the flotation device is worn by a person.

15. The flotation device of, claim 13, wherein the central section, front and rear flotation packs are covered with two-millimeters of nylon #2 neoprene thereby providing a soft and comfortable feel when the flotation device is worn by a person.

16. A flotation device to enable a person to float with minimal effort in a body of water, comprising:

a central section having a first and second opposite ends, wherein the central section comprises a flotation material made of urethane closed cell foam, wherein the central section is adapted to fit between a person's legs;

a front and a rear flotation pack each comprising urethane closed cell foam, wherein the front pack has a first and second opposite sides and a lower and upper end, wherein the rear pack has a third and fourth opposite sides and a lower and upper end, wherein the lower end of the front pack is attached to the first opposite end of the central section, and the lower end of the rear pack is attached to the second opposite end of the central section; and an adjustable connection means, wherein the adjustable connection means reversibly connects the front and rear flotation packs, whereby the flotation device can be fitted to a person by placing the central section between a person's legs and the front and rear flotation packs respectively to the front and rear of the person's trunk using the first and second reversible connection means thereby allowing the person to float with minimum effort in a body of water.

17. The flotation device of claim 16, wherein the central section, front and rear flotation packs are covered with nylon #2 neoprene thereby providing a soft and comfortable feel when the flotation device is worn by a person.

18. The flotation device of claim 16, wherein the central section, front and, rear flotation packs are covered with two-millimeters of nylon #2 neoprene thereby providing a soft and comfortable feel when the flotation device is worn by a person.

* * * * *